US005749251A

United States Patent [19]

Keefe

[11] Patent Number: 5,749,251

[45] Date of Patent: May 12, 1998

[54] LOCKING DEVICE AND SKI SECURITY SYSTEM

[76] Inventor: Jerome F. Keefe, 18 Priscilla Rd., Hopkinton, Mass. 01748

[21] Appl. No.: 381,714

[22] Filed: Jan. 31, 1995

[51] Int. Cl.[6] ..... E05B 37/06

[52] U.S. Cl. ..... 70/30; 211/70.5; 70/312; 70/58; 280/814

[58] Field of Search ..... 70/14, 18, 19, 70/22, 26, 30, 49, 57, 58–62, 286–288, 304–305, 308, 309–312, 315–319, DIG. 35, DIG. 60; 211/4, 70.5; 280/814

[56] References Cited

U.S. PATENT DOCUMENTS

| | | | |
|---|---|---|---|
| 488,648 | 12/1892 | Covington | 70/26 X |
| 1,177,093 | 3/1916 | Evans | 70/30 |
| 1,383,317 | 7/1921 | McAdoo | 70/312 X |
| 1,728,902 | 9/1929 | Cohen | 70/26 |
| 2,128,114 | 8/1938 | Benedetti | 211/4 |
| 3,590,608 | 7/1971 | Smyth | 280/814 X |
| 3,636,739 | 1/1972 | Smedley | 280/814 X |
| 3,727,934 | 4/1973 | Averbook et al. | 280/814 |
| 3,739,606 | 6/1973 | Pyzel | 280/814 X |
| 4,302,955 | 12/1981 | Kawakami | 70/30 |
| 4,461,385 | 7/1984 | Clouser | 211/4 |
| 4,673,088 | 6/1987 | Mancini | 211/70.5 |
| 4,813,252 | 3/1989 | Ray | 70/18 |
| 5,285,906 | 2/1994 | Wisnowski et al. | 211/70.5 |
| 5,316,155 | 5/1994 | Collins et al. | 211/4 X |
| 5,325,686 | 7/1994 | Bentley | 211/4 X |
| 5,406,811 | 4/1995 | Nakai | 70/30 X |

FOREIGN PATENT DOCUMENTS

| | | | |
|---|---|---|---|
| 1335767 | 7/1963 | France | 211/70.5 |
| 628985 | 7/1934 | Germany | 70/30 |
| 17128 | 6/1898 | Switzerland | 70/226 |
| 243551 | 7/1946 | Switzerland | 70/30 |
| 262303 | 6/1949 | Switzerland | 211/70.5 |

*Primary Examiner*—Suzanne Dino
*Attorney, Agent, or Firm*—Shenier & O'Connor

[57] ABSTRACT

A locking device and security system including a cable having two ends, each end having a notched rod, and a barrel-shaped operating mechanism having a passage through its center along its longitudinal axis. Each notched rod has a length half of the length of the cylindrical body portion; one of the notched rods is insertable at one end of the body portion into the passage and the other notched rod is insertable at the opposite end of the body portion into the passage.

6 Claims, 4 Drawing Sheets

LOCKING DEVICE AND SKI SECURITY SYSTEM

FIELD OF THE INVENTION

As any skier knows, leaving expensive skis unattended at a ski rack outside of the ski lodge can be a nerve-racking experience. Many skiers cannot help but worry if their skis will still be there when they return because of a sharp increase in ski theft from these racks. One prior art solution to the problem of ski theft has been to equip the ski areas with racks that have locks built in to them in which the skier must insert up to a dollar (in change) for each use. These racks are expensive for the ski areas to purchase and install and are expensive for skiers to use, not to mention the inconvenience of having to carry around pockets full of change to use the locks.

Another solution is for skiers to purchase ski carriers for attaching the skis to racks with a cable. These carriers are expensive, cumbersome and can be difficult to use, especially with gloves or mittens on.

SUMMARY OF THE INVENTION

It is therefore an object of the invention to provide a locking device and ski security system which is inexpensive, easy to use, portative, or easily carried, and small enough to fit into the skier's pocket when not in use. The locking device and ski security system of the present invention allows a skier to lock his or her skis to a conventional ski rack without having to carry around expensive, cumbersome carrier/cable locks or a pocket full of change for the coin-operated locking racks. All the skier needs to do is use the locking device of the present invention in conjunction with a cable which is attached to preexisting ski racks to lock his or her skis to the rack. When not in use, the skier can carry the inexpensive, compact locking device in his or her pocket. The only expense for the skier is the one-time purchase price of the locking device. Ideally, the locking device will be able to be used at several different ski areas.

The invention includes a barrel-shaped operating mechanism, a plurality of openings for receiving separate bolt means and means for engaging each of the bolt means, in which the operating mechanism can be completely disconnected from the bolt means. The means for engaging includes a plurality of rotors.

The invention further includes a flexible body or cable means for interconnecting the bolt means. The openings are located at opposite ends of the operating mechanism. When the rotors are aligned in predetermined positions, the bolt means are allowed to slide in and out of the openings. When the rotors are in any positions other than the predetermined positions, when the bolt means are in the openings, the bolt means are prevented from being removed from the openings.

It is a further object of the invention to provide a security system for skis including the operating mechanism and means, fixed to a rack, for securing objects to the rack, in which the bolt means of the operating mechanism are interconnected by the securing means. The means for engaging of the operating mechanism include means, axially rotatable about the openings, for engaging the bolt means.

It is a further object of the invention to provide a ski rack lock including ski securing means having a flexible body fixed to the ski rack for locking skis with respect to the rack and operating means which engage the securing means in a first configuration for allowing a skier to lock skis to the rack and which completely disconnects from the securing means in a second configuration for allowing the operating means to be portative.

It is a further object of the invention to provide a locking device including cable means having two ends, each end including a notched rod and a barrel-shaped body portion having a passage through its center along its longitudinal axis. Each notched rod has a length half of the length of the barrel-shaped body portion and one of the notched rods is insertable at one end of the body portion and the other notched rod is insertable at the opposite end of the body portion into the passage.

The invention results from the realization that an inexpensive, compact and easy-to-use locking device can be made from a barrel-shaped operating mechanism having openings at either end for receiving bolt means which are attached to both ends of a cable which, in turn, is attached to a ski rack. The operating mechanism is portative, or easily carried, and small enough to fit in any jacket pocket and therefore is less cumbersome than a complete carrier/cable system. It is also less expensive because all the skier needs to purchase is the operating mechanism. To keep costs to a minimum for the ski area, the cable can be attached to, and the security system used with, pre-existing ski racks.

DISCLOSURE OF THE PREFERRED EMBODIMENT

Other objects, features and advantages will occur to those skilled in the art from the following description of a preferred embodiment and the accompanying drawings in which.

Figure 1:
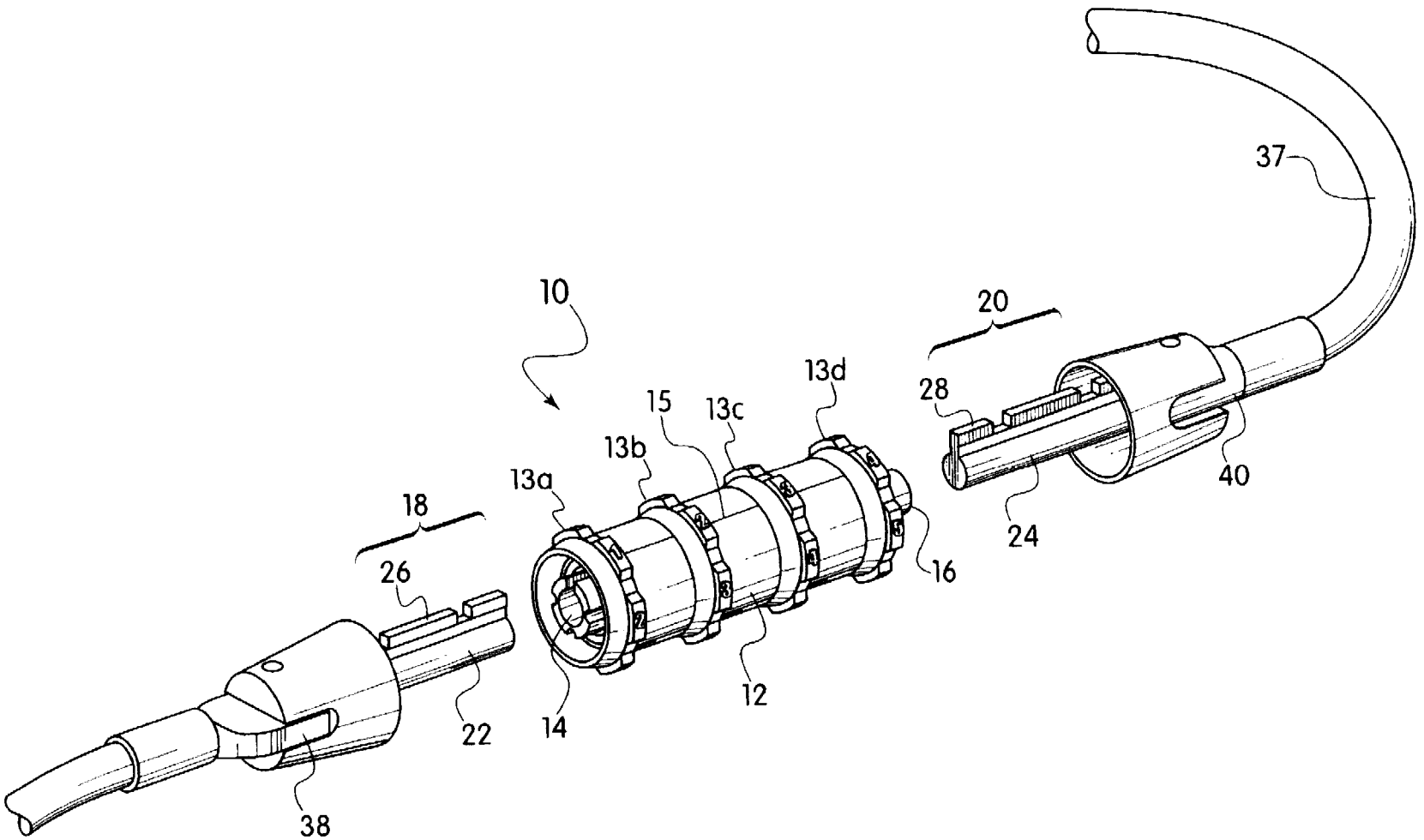
FIG. 1 is a schematic drawing of the operating mechanism, cable and bolt portions.

In FIG. 1, there is shown a locking device 10 having an operating mechanism 12 which, in a preferred embodiment, is barrel shaped. Operating mechanism 12 has openings 14 and 16 at either end. Openings 14 and 16 form a passage which passes through the operating mechanism along its longitudinal axis. Openings 14 and 16 are formed to receive bolt portions 18 and 20, respectively. Bolt portion 18 is received by opening 14 and bolt portion 20 is received by opening 16. Rotors 13*a*–13*d* are integrated with operating mechanism 12 at equal distances from each other with two rotors being at either end of the operating mechanism. Reference line 15 runs longitudinally along operating mechanism 12. The design of the locking device allows the operating mechanism to be completely removed from both bolt portions. This enhances portability by allowing the user to carry the operating mechanism in his or her pocket until he or she wishes to use the operating mechanism to lock his or her skis to a ski rack.

Figure 2:
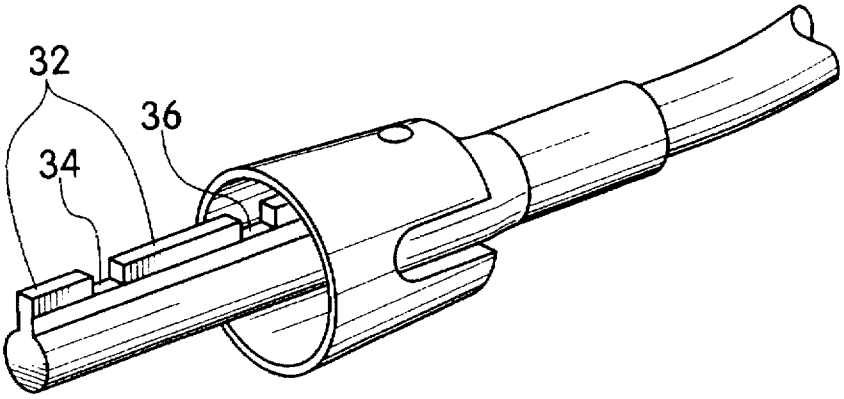
FIG. 2 is a schematic drawing of one of the bolt portions.

Bolt portions 18 and 20 each include a rod section 22 and 24 and a notched portion 26 and 28, respectively. As can be seen in FIG. 2, each notched portion is made up of a wall section 32 and notches 34 and 36. A cable 37 is attached to swivel connectors 38, 40 which are then attached to the bolt portions 18 and 20.

Each rotor 13*a*–13*d* is capable of being rotated between six positions. These positions are designated by the numbers 0–5 located around the perimeter of the rotors as shown in FIG. 1. Operating mechanism 12 is in an unlocked position when the designated combination of numbers is aligned with reference line 15. For example, the numerical combination which unlocks the locking device of FIG. 1 is 1-2-3-4.

Figure 3:
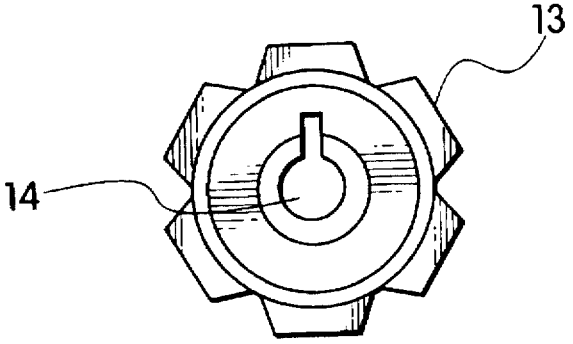
FIG. 3 is an end view of the operating mechanism.
Figure 4:
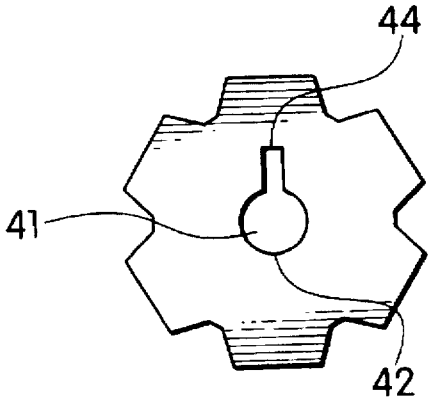
FIG. 4 is a side view of one of the rotors.

FIG. 3 is an end view of operating mechanism 12. When all four rotors are in the predetermined positions designated by the numerical combination (i.e. the operating mechanism is unlocked) the bolt portions 18 and 20 are allowed to be slid in and out of openings 14 and 16, respectively. This is possible because each rotor, shown in side view in FIG. 4, has a central hole 41 having a rounded portion 42 and a squared portion 44 which coincides with the cross-sectional shape of bolt portions 18 and 20. When the rotors 13*a*–13*d* are in proper alignment, bolt portions 18 and 20 will pass through rotors 13*a*–13*d*.

Figure 5:
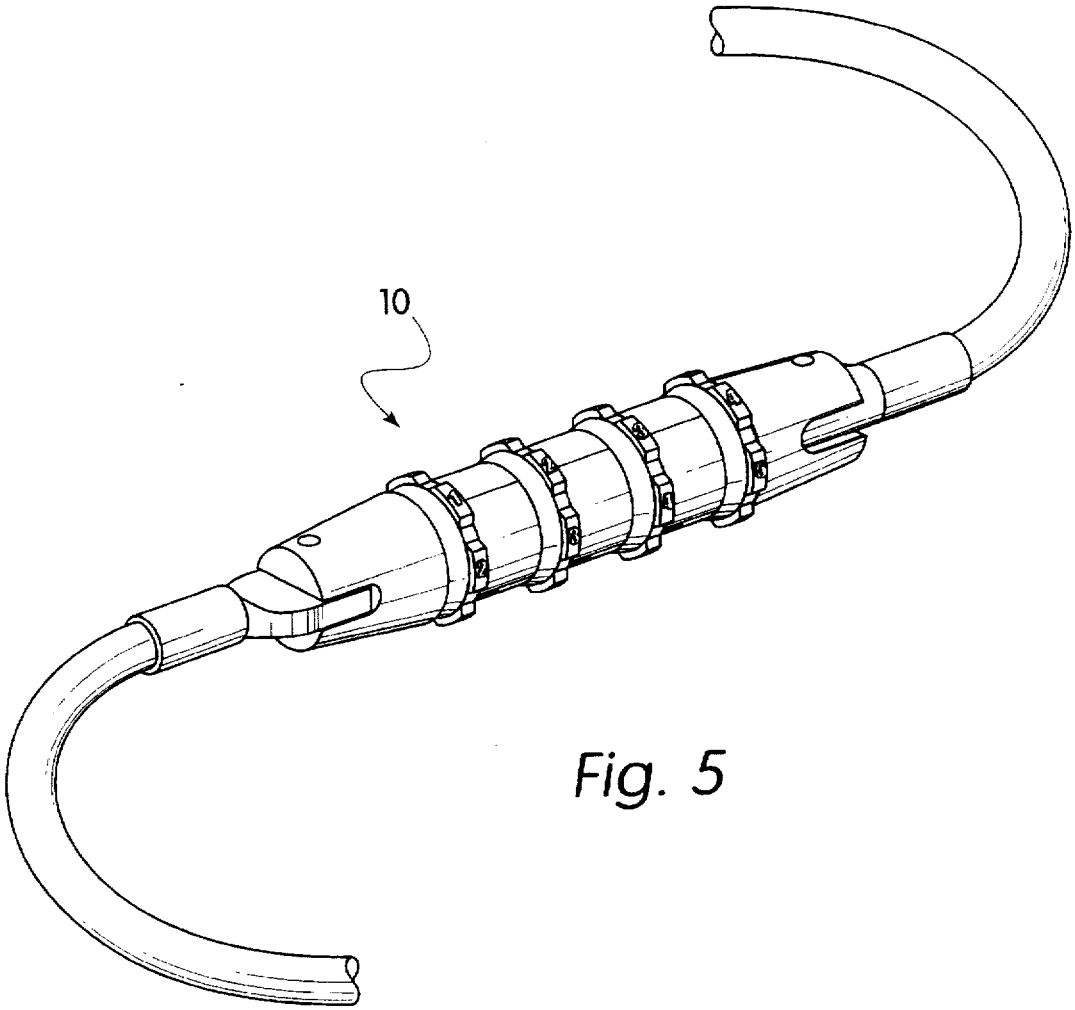
FIG. 5 is a schematic drawing of the locking device in a locked position.

When one or more of the rotors are not in the predetermined positions when each bolt portion is in each opening (i.e. the operating mechanism is locked) the rounded portion 42 of hole 41 engages a corresponding notch 34 and 36 on the bolt portion 18 and 20 to prevent the bolt portion 18 and 20 from being removed from the opening 14 and 16, respectively. Each of the four rotors 13*a*–13*d* engages one of the two notches 34 and 36 on each of the two bolt portions 18 and 20, respectively. FIG. 5 shows the locking device in a locked position.

Figure 6:
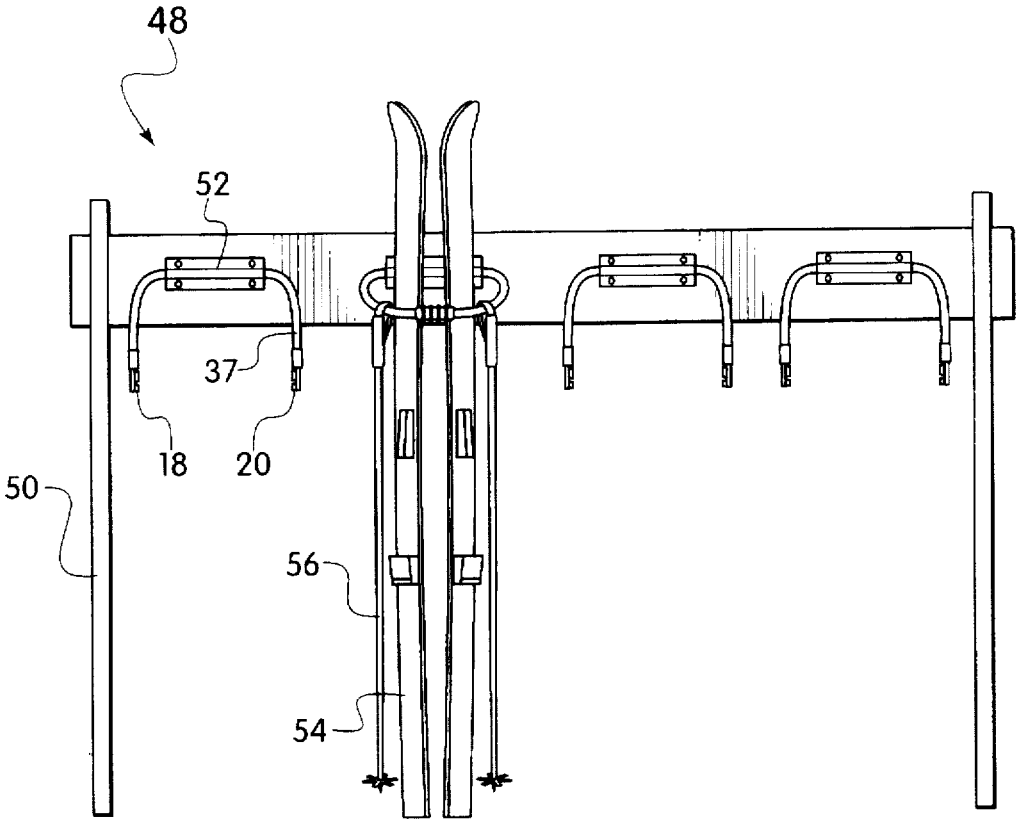
FIG. 6 is a schematic drawing of the ski security system using the locking device.
Figure 7:
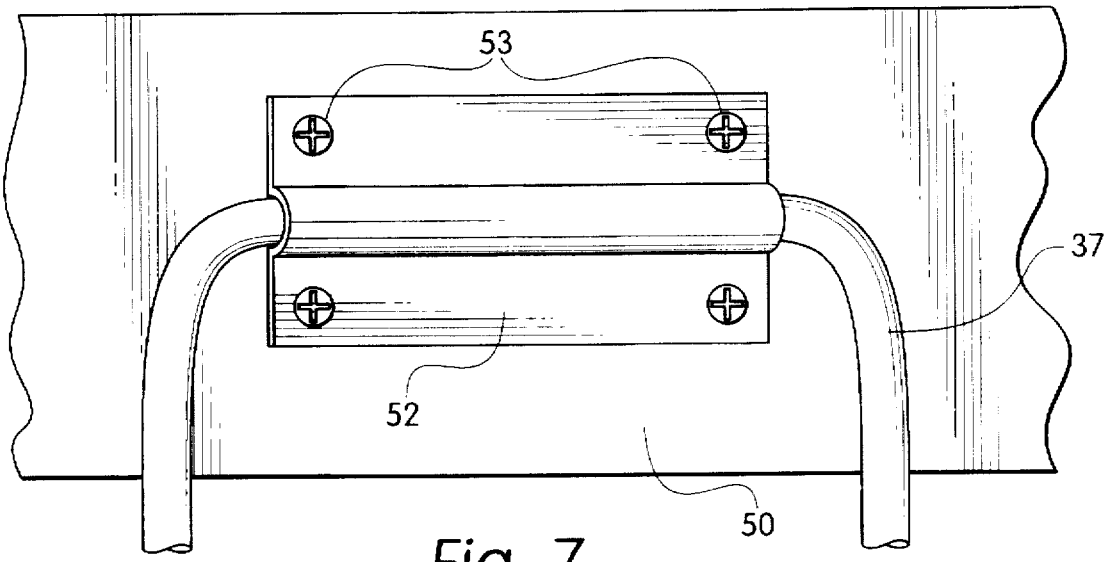
FIG. 7 is a schematic drawing of the connection of the cable to the rack in the security system of FIG. 6.

A security system 48 for skiing equipment utilizing the locking device of FIG. 1 is shown in FIG. 6. Cable 37 is mounted on rack 50 at the midpoint of the cable by bracket 52 and screws 53. A closer view of the bracket assembly is shown in FIG. 7. Referring again to FIG. 6, during use skis 54 are placed against rack 50 at bracket 52. Cable 30 is looped around the skis, bolt portion 18 is inserted into opening 14 of the operating mechanism, bolt portion 20 is inserted into opening 16 of the operating mechanism and the rotors are moved to positions other than the predetermined positions to lock the skis in place. Cable 30 is approximately 12"–14" in length so that when the skis are locked, the cable will be tight enough so that the ski tips or bindings will not be allowed to pass through the loop. Ski poles 56 can also be locked by running the cable through the poles' wrist straps.

This invention allows the skier to lock his or her skis without having to carry around bulky, cumbersome ski carrier/cable systems or pockets full of change. The invention is less expensive than the carrier/cable systems and will pay for itself after only a few uses compared to the coin operated rack locks. The operating mechanism is portative and inexpensive, which makes the invention ideal for skiers who want to conveniently and economically protect their investment in their skiing equipment.

Although specific features of this invention are shown in some drawings and not others, this is for convenience only as each feature may be combined with any or all other features in accordance with the invention.

Other embodiments will occur to those skilled in the art and are within the following claims.

What is claimed is:

1. A lock including in combination:

a first shackle leg, a second shackle leg, and a casing having an axis and a plurality of axially-spaced rotatable locking members and an axially-extending aperture for receiving said first and second shackle legs, said received shackle legs being axially spaced from one another wherein each locking member radially surrounds a single received shackle leg so that said shackle legs are independently lockable to said casing.

2. The apparatus of claim 1, wherein said casing and said shackle legs include cooperating means for preventing relative rotational movement between said shackle legs and said casing.

3. The apparatus of claim 1, wherein each rotatable locking member has a plurality of angular positions only one of which permits axial movement of a shackle leg.

4. The apparatus of claim 1, wherein said shackle legs include axially spaced apart lugs with each of said rotatable locking members being axially aligned with one of the spaces between said lugs of one of said received shackle legs.

5. The apparatus of claim 4, wherein each rotatable locking member includes a single notch which is aligned with said lugs to define an unlocked position for one of said received shackle legs.

6. The apparatus of claim 1, wherein said casing has a length L and each shackle leg has a length of approximately L/2.

* * * * *